US008324122B2

(12) United States Patent
Juhász et al.

(10) Patent No.: US 8,324,122 B2
(45) Date of Patent: Dec. 4, 2012

(54) AROMA-THERAPEUTIC BEDDING SET

(76) Inventors: Levente Juhász, Nyiregyháza (HU); Leventéné Juhász, Nyiregyháza (HU)

( * ) Notice: Subject to any disclaimer, the term of this patent is extended or adjusted under 35 U.S.C. 154(b) by 643 days.

(21) Appl. No.: 12/524,060

(22) PCT Filed: Apr. 25, 2007

(86) PCT No.: PCT/HU2007/000037

§ 371 (c)(1), (2), (4) Date: Jul. 22, 2009

(87) PCT Pub. No.: WO2008/090390

PCT Pub. Date: Jul. 31, 2008

(65) Prior Publication Data

US 2010/0080950 A1 Apr. 1, 2010

(30) Foreign Application Priority Data

Jan. 22, 2007 (HU) ..... 0700073

(51) Int. Cl.

| | |
|---|---|
| ***B32B 5/16*** | (2006.01) |
| ***D04H 1/04*** | (2006.01) |
| ***A47C 20/00*** | (2006.01) |

(52) U.S. Cl. ..... 442/417; 442/415; 5/641

(58) Field of Classification Search ..... 442/415, 442/417; 5/636, 641

See application file for complete search history.

(56) References Cited

U.S. PATENT DOCUMENTS

| | | | | |
|---|---|---|---|---|
| 3,382,509 | A * | 5/1968 | Lupke et al. | 5/641 |
| 5,819,347 | A | 10/1998 | Masuda | |
| 6,430,764 | B1 | 8/2002 | Peters | |

FOREIGN PATENT DOCUMENTS

| | | | |
|---|---|---|---|
| AT | 006604 | U1 | 1/2004 |
| DE | 3101277 | A1 | 9/1982 |
| DE | 3140931 | A1 | 5/1983 |
| DE | 19602825 | C1 | 8/1997 |
| DE | 29722303 | U1 | 4/1998 |
| GB | 2360206 | A | 9/2001 |
| JP | 11309053 | A | 11/1999 |

* cited by examiner

*Primary Examiner* — Jenna Johnson

(74) *Attorney, Agent, or Firm* — Novak Druce + Quigg LLP

(57) ABSTRACT

The object of the invention is an aroma-therapeutic bedding set comprising a filling consisting of fibre fleece layers, made of natural or synthetic fibres or a mixture thereof, or fibres placed in an outside ticking, and containing preferably evenly distributed dried and cut herbs embedded in the fibres, or between the layers and embedded in the fibres of the layers.

13 Claims, 1 Drawing Sheet

AROMA-THERAPEUTIC BEDDING SET

Figure 1:
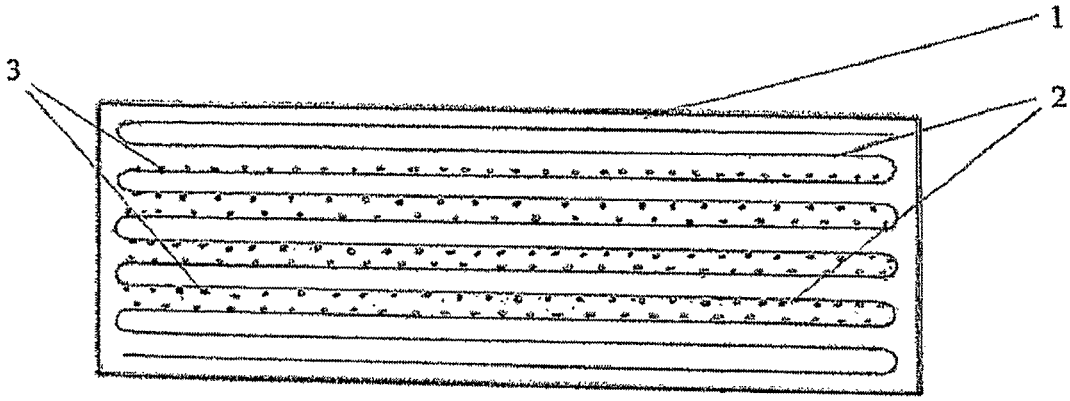

The object of the invention is an aroma-therapeutic bedding set, characterized by the fact that it contains dried herb pieces distributed evenly between the layers of the fibre fleece filling or the fibres of the bedding set. The invention also covers the manufacturing of the bedding set and a herb dispersing structure required for the manufacture thereof.

Prehistoric man already knew and used herbs to cure various diseases. In Hungary there are more than a thousand species of plants to which popular knowledge attributes healing power. Now their healing power can be proven scientifically, clinically and by laboratory tests, it is medically recognized and accepted.

Herbs are used in many forms and ways, in drugs as active substance, in herbal teas, in the form of creams, ointments, body lotions, oils, etc.

Aroma-therapy is based on the healing power of essential oils and today it forms an independent therapeutic field. Therapeutic aromas can be used in several ways, e.g. evaporation, aroma bath, inhalation, massage. The demand for preparations containing essential oils is increasing and they are also gaining ground in treatment, primarily in prevention and in improving physical and mental health.

In the past years there have been a number of attempts to fill herbs or their essential oils into bedding sets, mainly pillows, facilitating thereby the inhalation of the aroma at night, during sleep.

The simple solution, when herbs are used as stuffing and are filled into pillows (e.g. utility model application No. U0200241) is self-evident. These pillows, however, due mainly to their discomfort, have not come into general use, or only to a limited extent. The pillows rustle-rattle in use, they may pierce or press, leave an impression on the face. During use the herb pieces rub together or against each other, crumble, disintegrate, resulting in continuous dust formation, and the inhalation of dust may cause irritation. Another disadvantage is that a large amount of herbs is required for filling a pillow, as a result of which a stronger than necessary, excessive aromatic effect may occur, which in given cases may prevent peaceful, restful sleep. Therefore pillows filled purely with herbs are not convenient for continuous use and are not really recommendable either.

U.S. Pat. No. 6,430,764 describes a pillow scented with a herbal aroma, where essential oil is dropped on an absorbing material put in a separate pouch, which is placed in the stuffing of the pillow. The disadvantage of this solution is that the aroma is not distributed evenly in the pillow, and the separate pouch makes the filling of the pillow inhomogeneous.

Japanese patent No. 11309053 describes a pillow facilitating falling asleep, into which a cylindrical plastic container is placed. The container is filled with a granular aromatic substance. The aroma flows out at the right and left hand sides of the pillow from the openings at the two ends of the cylinder, and is inhaled by the sleeping person.

German patent No. 3101277 describes a solution according to which a pillow comprises a cover layer filled with herbs. This solution is actually similar to the pillow filled with herbs, the difference is that in this case a thin layer filled with herbs is applied.

German patent No. 3140931 describes a herbal pillow with long-lasting effect. The solution is suitable for using not completely dried herbs. The slow evaporation of the moisture content enhances the effect. Decay and mildew is prevented in such a way that the herb filling is surrounded by a shape-retaining multi-layer cover made of air permeable materials, horsehair and sheepwool.

German patent No. 19602825 describes a soothing and relaxing pillow, the filling of which is made of hop flowers.

British patent No. 2360206 describes a bedding set with micro-capsules containing an aromatic substance.

U.S. Pat. No. 5,819,347 describes a specially shaped pillow supporting the head and the neck, in the middle of which a bag containing the aroma of Japanese cypress is placed.

The main disadvantage of the inventions described above is that they offer quite complicated solutions and mainly for a certain purpose, using a particular herb.

The aim of the invention is an aroma-therapeutic bedding set containing any one or more known herbs, which is simple to manufacture, convenient to use, and ensures pleasant and restful sleep.

The set aim was achieved by developing a filling consisting of fibre fleece layers or fibres containing herbs, which can be used to manufacture any piece of the bedding set (pillow, quilt, mattress pad, mattress, mattress cover) in the known, simple way, and which eliminates the mentioned disadvantages, ensures pleasant, restful and peaceful sleep, and as the herbs contained in it cannot be felt physically during use, ensures perfect comfort even in continuous use.

The invention is based on the recognition that if herbs are dispersed evenly between the fibre fleece layers or the fibres of the bedding set, the herb pieces are perfectly embedded and fixed between the fibres. The rough, small protruding parts of the herbs embedded in the soft fibre fleece or the fibres cannot be felt, furthermore the dense fibres of the fleece prevent the migration of the pieces to one corner-tip of the bedding set during use.

The aroma-therapeutic bedding set according to the invention comprises a filling with herbs between fibre fleece layers, folded in a sandwich-like manner, or mixed with fibres, placed in an outside ticking. The main characteristic of the aroma-therapeutic bedding set is that it contains dried herb pieces distributed evenly between the layers, embedded between the fibres of the layers, or mixed with the fibres. A further characteristic of the bedding set is that in a filling made of fibre fleece layers the uppermost and lowermost two layers of the filling layered like a sandwich do not contain herbs.

The fibre fleece is made in the known manner from natural or synthetic fibres of different lengths and thicknesses, or a mixture thereof, preferably from polyester fibres, by carding.

The weight of the filling depends on the piece of the bedding set in question, namely whether it is a pillow, a duvet, a mattress pad, a mattress, or a mattress cover, and also whether e.g. a duvet is used as a winter or a summer quilt. In general, the filling of a small pillow weighs 200 g, the filling of a large pillow and an average winter duvet weighs 700 g, the filling of a summer duvet weighs 300 g. The number of layers depends on the size of the bedding set and the weight of the filling The aroma-therapeutic bedding set according to the invention contains 100 g of herbs for 200-1200 g of filling.

Any known herbs, e.g. lavender, lemon balm, peppermint, sage, anise, camomile, thyme, etc., can be used as herbs. In given cases a mixture of herbs can also be applied.

The filling containing the herbs is placed in an outside ticking. The material of the ticking is preferably cotton.

A herb dispersing structure was developed for the manufacture of the aroma-therapeutic bedding set according to the invention. The structure can be mounted on any known fibre fleece layering machine, or fibre separating machine, or unit suitable for filling pillows. The main parts of the structure are a trough open at the bottom, a shaking plate, and shaking eccentrics. One side of the trough having an irregular rectangular cross-section is fixed firmly to a supporting rod. An adjustable slot plate is fixed to the side in a moveable manner. The shaking plate is fixed to a supporting rod along its upper edge, its lower part extends beyond the trough underneath. Behind the shaking plate there are rectangular shaking eccentrics on a driving shaft. The bottom opening of the trough can be adjusted with the slot plate and an adjusting screw moving the plate, depending on the size of the herb pieces.

The herb dispersing structure shall be mounted on a layering machine in such a way that the eccentrics shall be placed on the driving shaft of the idler of the machine. During the operation of the machine, depending on the position of the eccentrics, the shaking plate either closes or opens the slot adjusted by the slot plate, through which the herb pieces are dispersed from the trough.

The herb dispersing structure shall be mounted on a fibre separating machine or a unit suitable for filling pillows in such a way that the rotation of the eccentric shaft shall be transmitted from the driving shaft of the machine without the idler, with continuous dispersing.

The aroma-therapeutic bedding set is manufactured in such a way that the fibre fleece made by carding the fibres is put into a fibre fleece layering machine equipped with a herb dispersing structure. The fibre fleece layering machine folds the fibre fleece successively, while the herb dispersing structure disperses the dried and cut herbs on each laid layer in such a way that the dispersing operation starts after the laying of the second layer and stops before the laying of the last but one layer. After that the filling containing the herbs is placed into an outside ticking and fixed. The fibre fleece filling can be placed into the ticking and fixed manually (pillow) or by machine (duvet).

According to a preferred embodiment of the manufacture of the aroma-therapeutic bedding set, pillows can be manufactured in such a way that the herb pieces are dispersed between the fibres with the herb dispersing structure, or manually. This operation can be performed e.g. in such a way that the herb dispersing structure is mounted on a fibre separating machine or a unit suitable for filling pillows (loosening, blowing machine). The herb pieces and fibres passing through the machine are mixed, then filled into a pillow ticking by means of air.

The method according to the invention can be applied to manufacture large pillows, half pillows, small pillows, quilts (duvets, sleeping bags), mattresses, mattress covers and mattress pads.

The invention is shown in more detail in the following figures:

FIG. 1: a schematic cross-sectional drawing of an aroma-therapeutic pillow with a filling made of fibre fleece layers.

Figure 2:
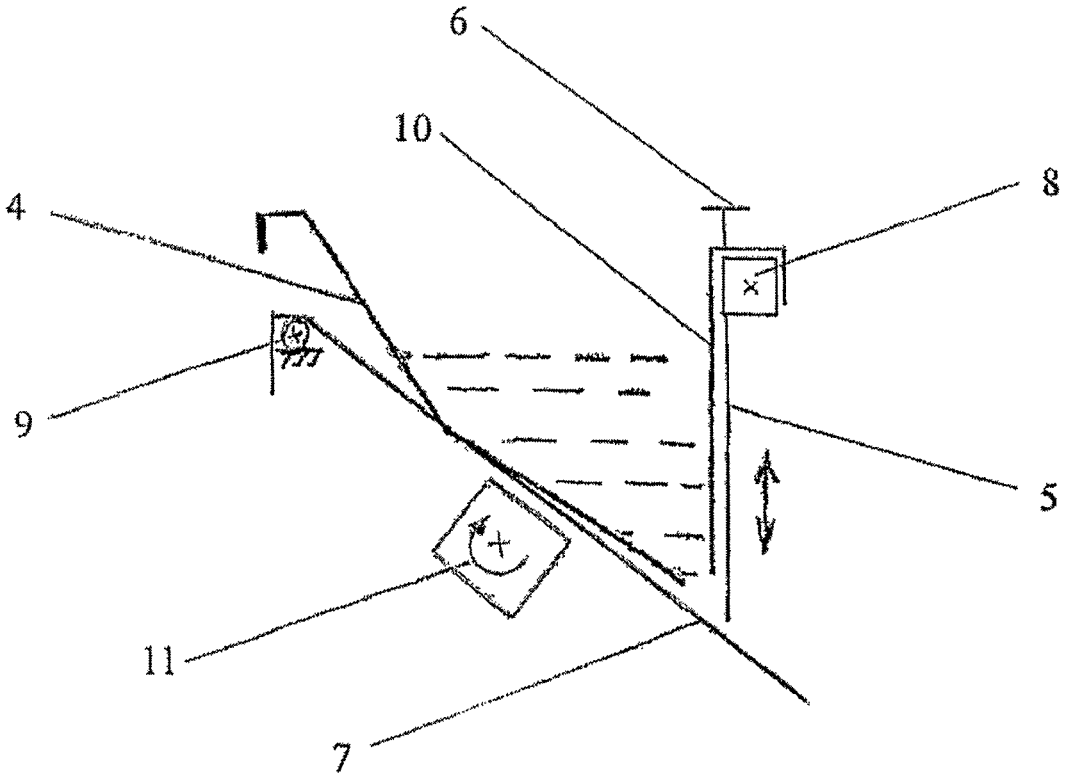

FIG. 2: a schematic cross-sectional drawing of the herb dispersing structure.

FIG. 1 shows a schematic cross-sectional drawing of an aroma-therapeutic pillow, showing the sandwich-like layered structure of the filling placed in the ticking 1, where there are herb pieces 3 between the fibre fleece layers 2, embedded in the fibres. It can be seen that there are no herbs between the two upper and two lower layers. This solution makes the bedding set according to the invention even more pleasant, more comfortable. The two lower and two upper herb-free layers of fibre fleece form soft closing layers, which perfectly prevent the herb pieces from being physically felt. At the same time the aroma of the herbs can pass through the filling between the fibres of the fibre fleece layers unhindered and can exert its healing power.

In general, an aroma-therapeutic small pillow contains 200 g of filling and 50 g of herbs, a large pillow or a duvet 700 g of filling and 100 g of herbs. Naturally, deviation from these values is possible, as necessary. E.g. summer duvets contain 300 g of filling and 50 g of herbs, warmer winter duvets contain 1200 g of filling and 100 g of herbs.

The size of the applied herb pieces is a few mm: e.g. camomile flowers of a diameter of about 5 mm, 3 mm cut peppermint or lemon balm leaves, or 5 mm long and 2 mm thick lavender flowers.

FIG. 2 shows an embodiment of the herb dispersing structure.

The advantage of the aroma-therapeutic bedding set according to the invention is that it is simple to manufacture, convenient, and ensures perfect comfort. It has a long service life, depending on the type and quantity of the herbs it exerts its power for 2 to 3 years. Another major advantage is that the bedding set is washable.

The invention claimed is:

1. An aroma-therapeutic bedding set comprising a filling of fibre fleece layers placed in an outside ticking, wherein the fibre fleece layers comprise natural or synthetic fibres or mixtures thereof, and wherein the filling contains dried and cut herbs distributed and embedded between the layers and embedded between the fibres of the layers.

2. An aroma-therapeutic bedding set comprising a filling of fibres placed in an outside ticking, wherein the fibres comprise natural or synthetic fibres or mixtures thereof, and wherein said filling contains dried and cut herbs distributed and embedded between the fibres.

3. The aroma-therapeutic bedding set according to claim 1, wherein the layer thickness of the fibre fleece is 0.1-2.0 cm.

4. The aroma-therapeutic bedding set according to claim 1, wherein the filling comprises two uppermost and two lowermost fibre fleece layers and wherein there are no herbs between the uppermost and the lowermost two layers of the filling.

5. The aroma-therapeutic bedding set according to claim 1, which contains 100 g of herbs for 200-1200 g of filling.

6. The aroma-therapeutic bedding set according to claim 1, which is in form of a small pillow containing 200 g of filling and 50 g of herbs.

7. The aroma-therapeutic bedding set according to claim 1, which is in form of a large pillow containing 700 g of filling and 100 g of herbs.

8. The aroma-therapeutic bedding set according to claim 1, which is in form of a duvet containing 300-700 g of filling and 50-100 g of herbs.

9. The aroma-therapeutic bedding set according to claim 1, wherein the dried and cut herbs are evenly distributed and embedded between the layers.

10. The aroma-therapeutic bedding set according to claim 2, which contains 100 g of herbs for 200-1200 g of filling.

11. The aroma-therapeutic bedding set according to claim 2 which is in form of a small pillow containing 200 g of filling and 50 g of herbs.

12. The aroma-therapeutic bedding set according to claim 2 which is in form of a large pillow containing 700 g of filling and 100 g of herbs.

13. The aroma-therapeutic bedding set according to claim 2, wherein the dried and cut herbs are evenly distributed and embedded between the layers.

* * * * *